US007115072B1

(12) United States Patent
Stoll

(10) Patent No.: US 7,115,072 B1
(45) Date of Patent: Oct. 3, 2006

(54) MOTION RESISTANCE APPARATUS

(75) Inventor: Henry William Stoll, 885 Bosworthfield Rd., Barrington, IL (US) 60010

(73) Assignee: Henry William Stoll, Barrington, IL (US)

( * ) Notice: Subject to any disclaimer, the term of this patent is extended or adjusted under 35 U.S.C. 154(b) by 522 days.

(21) Appl. No.: 10/072,258

(22) Filed: Feb. 7, 2002

Related U.S. Application Data

(60) Provisional application No. 60/267,191, filed on Feb. 8, 2001.

(51) Int. Cl.
*A63B 23/04* (2006.01)
*A63B 69/16* (2006.01)

(52) U.S. Cl. ..... 482/51; 482/63

(58) Field of Classification Search ..... 482/51–53, 482/57–65; 474/101; 198/370.1
See application file for complete search history.

(56) References Cited

U.S. PATENT DOCUMENTS

| | | | | |
|---|---|---|---|---|
| 142,365 | A * | 9/1873 | Smith | 74/1 R |
| 1,820,372 | A | 8/1931 | Blomquist | 482/129 |
| 3,224,765 | A | 12/1965 | Baker et al. | 272/79 |
| 3,751,033 | A | 8/1973 | Rosenthal | 272/58 |
| 4,417,724 | A | 11/1983 | Bikker | 272/73 |
| 5,031,902 | A | 7/1991 | Findlay | 272/73 |
| 5,033,733 | A | 7/1991 | Findlay | 272/70 |
| 5,116,294 | A * | 5/1992 | Findlay | 482/52 |
| 5,279,529 | A | 1/1994 | Eschenbach | |
| 5,314,392 | A | 5/1994 | Hawkins et al. | 482/57 |
| 5,478,299 | A | 12/1995 | Harmon et al. | 482/129 |
| 5,692,994 | A | 12/1997 | Eschenback | 482/57 |
| 5,833,583 | A | 11/1998 | Chuang | 482/60 |
| 5,954,611 | A * | 9/1999 | Mills et al. | 475/182 |
| 6,334,836 | B1 * | 1/2002 | Segasby | 482/4 |

* cited by examiner

*Primary Examiner*—Stephen R. Crow
(74) *Attorney, Agent, or Firm*—Katten Muchin Roseman LLP; John S. Paninguas

(57) ABSTRACT

One embodiment of the apparatus for resisting motion comprises: a framework having spaced apart, first and second sides; a sun pulley fixedly mounted to the first side; a rotatably adjustable pulley mounted on the second side opposite the sun pulley; a load torque shaft fixed to the adjustable pulley; an input torque shaft positioned coaxial with the fixed sun pulley and with the load torque shaft and being rotatable relative to the fixed sun pulley; an arm having a first end fixed to the input torque shaft and a second end mounting a planetary shaft which extends transversely of the arm and parallel to an axis of the input torque shaft; a first planetary pulley fixedly mounted on the planetary shaft in alignment with the fixed sun pulley; a second planetary pulley fixedly mounted on the planetary shaft in alignment with the adjustable pulley; a first belt or chain trained over the sun pulley and the first planetary pulley; and a second belt or chain trained over the adjustable pulley and the second planetary pulley, whereby placement of a torque on the load torque shaft fixed to the adjustable pulley will place tension on one length of the first belt or chain and tension on the other length of the second belt or chain thereby to establish friction between adjacent moving parts throughout the apparatus thereby to establish resistance to rotary movement of the input torque shaft with the amount of resistance being dependent on the amount of torque placed on the load torque shaft.

20 Claims, 4 Drawing Sheets

Unloaded

Loaded

MOTION RESISTANCE APPARATUS

BACKGROUND OF THE INVENTION

1. Field of the Invention

The present invention relates to an apparatus for providing resistance to motion, such as rotary motion. The purpose of the present invention is to provide a relatively low cost, lightweight, easy to adjust, quiet, and reliable motion resistance device or apparatus for use in exercise equipment, rehabilitation equipment, and other equipment where adjustable resistance to an input motion is desired.

2. Description of the Related Art

While many motion resistance devices heretofore have been proposed, most of them have a focused point of resistance, like a clutch brake on a drum, which leads to focused wear, e.g., between the brake and the drum. This leads to wear and the requirement to replace the worn parts.

Many exercise devices operate by requiring the user to work against a resistance that opposes the motion of the user. Developing this resistance or opposing force (torque) has been a traditional problem in exercise and rehabilitation equipment. In high-end devices, a magnetic brake or eddy current device is commonly used, but these are expensive and heavy. Wind turbines are also commonly used, but these are often large, heavy, noisy, and are usually not adjustable. Friction devices such as disc brakes and other rubbing devices are also used, but these are often noisy, hard to adjust, and subject to wear.

Several examples of non-analogous motion resistance devices are disclosed in the following non-analogous United States patents.

| U.S. Pat. No. | Patentee |
|---|---|
| 1,820,372 | Blomquist |
| 3,751,033 | Rosenthal |
| 4,417,724 | Bikker |
| 5,031,902 | Findlay |
| 5,033,733 | Findlay |
| 5,116,294 | Findlay |
| 5,314,392 | Hawkins et al. |
| 5,478,299 | Harmom et al. |
| 5,692,994 | Eschenbach |
| 5,833,583 | Chuang |

BRIEF SUMMARY OF THE INVENTION

According to the present invention there is provided an apparatus for resisting motion comprising: a framework having spaced apart, first and second sides; a sun gear fixedly mounted to the first side; a rotatably adjustable gear mounted on the second side opposite the sun gear; a load torque shaft fixed to the adjustable gear; an input torque shaft positioned coaxial with the fixed sun gear and with the load torque shaft and being rotatable relative to the fixed sun gear; an arm having a first end fixed to the input torque shaft and a second end mounting a planetary shaft which extends transversely of the arm and parallel to an axis of the input torque shaft; a first planetary gear fixedly mounted on the planetary shaft in alignment and engagement with the fixed sun gear; a second planetary gear fixedly mounted on the planetary shaft in alignment and engagement with the adjustable gear, whereby placement of a torque on the load torque shaft fixed to the adjustable gear will place load on engaging teeth between the adjustable gear and the second planetary gear and on the engaging teeth between the first planetary gear and the fixed sun gear thereby to establish friction between adjacent moving parts throughout the apparatus thereby to establish resistance to rotary movement of the input torque shaft with the amount of resistance being dependent on the amount of torque placed on the load torque shaft.

Also according to the present invention, there is provided an apparatus for resisting motion comprising: a framework having spaced apart, first and second sides; a sun pulley fixedly mounted to the first side; a rotatably adjustable pulley mounted on the second side opposite the sun pulley; a load torque shaft fixed to the adjustable pulley; an input torque shaft positioned coaxial with the fixed sun pulley and with the load torque shaft and being rotatable relative to the fixed sun pulley; an arm having a first end fixed to the input torque shaft and a second end mounting a planetary shaft which extends transversely of the arm and parallel to an axis of the input torque shaft; a first planetary pulley fixedly mounted on the planetary shaft in alignment with the fixed sun pulley; a second planetary pulley fixedly mounted on the planetary shaft in alignment with the adjustable pulley; a first belt or chain trained over the sun pulley and the first planetary pulley; and a second belt or chain trained over the adjustable pulley and the second planetary pulley, whereby placement of a torque on the load torque shaft fixed to the adjustable pulley will place tension on one length of the first belt or chain and tension on the other length of the second belt or chain thereby to establish friction between adjacent moving parts throughout the apparatus thereby to establish resistance to rotary movement of the input torque shaft with the amount of resistance being dependent on the amount of torque placed on the load torque shaft.

In one embodiment, the outer surface of each pulley has teeth and grooves and the inner surface of the belts having mating grooves and teeth.

In another embodiment the pulleys are sprockets and the belts are chains.

DETAILED DESCRIPTION OF THE INVENTION

The principle of operation of each embodiment of the apparatus of the present invention is based on a planetary gear train that has been designed to operate as a resistance device by making the speed ratio (ratio of output speed to input speed) equal zero. In the operation of the embodiment illustrated in FIGS. 1–3, the user rotates the input shaft in either direction by applying a torque to the input shaft. This can be done either directly by using pedals (i.e., cranks), or indirectly via a belt or chain or other type of drive.

As the input shaft is rotated, the gears rotate and move such that the net rotation of the output shaft is zero. This is possible because of the special nature of planetary gear trains. Consequently, in this device, the output shaft remains stationary regardless of the speed of rotation of the input shaft. The amount of torque that must be applied by the user to rotate the input shaft depends on the load torque applied to the output shaft. Because the output shaft is stationary, load torque is easily applied by hanging weights on a lever arm or by applying force to the lever arm by using a screw or other load application method (e.g., cam, pneumatic actuator, etc.).

Figure 1:
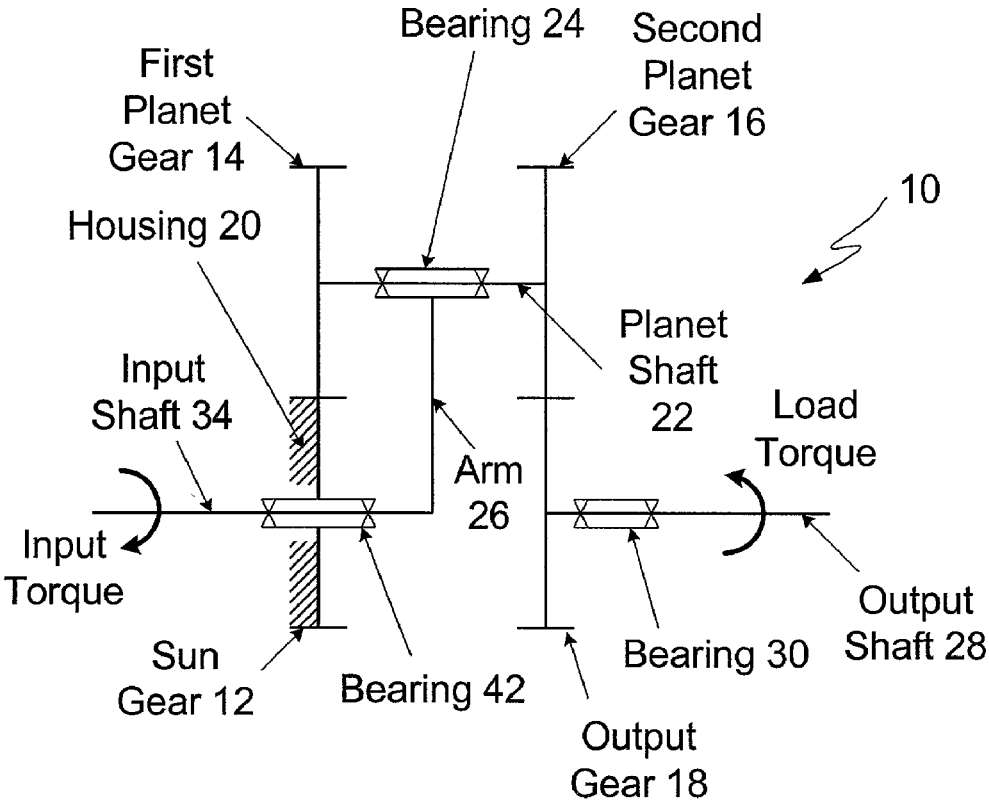
FIG. 1 is schematic diagram of one embodiment of the apparatus of the invention employing gears.

Operation of one embodiment of the device or apparatus 10 constructed according to the teachings of the present invention is shown schematically in FIG. 1. As shown, a sun gear 12, first and second planetary gears 14 and 16, and an output gear 18 form the gear train. The sun gear 12 is attached to a framework or housing 20 and therefore cannot rotate. The first and second planetary gears 14 and 16 are both attached (keyed) to the same shaft 22, which is free to rotate in a bearing 24 carried by an arm 26. The second planetary gear 16 meshes with the output gear 18. The output gear 18 is attached (keyed) to an output shaft 28, which is supported by a bearing 30 and is also free to rotate. Load torque is applied to the output shaft 28 by pushing on or by hanging weights on a load arm 32 (FIG. 2) that is attached to the output shaft 28. The load torque is transmitted through the gear train to the sun gear 12. Since the sun gear 12 is "fixed" (i.e., attached to the housing 20), it cannot rotate. Hence, the load torque is essentially "locked" into the gear train so that the teeth of each gear 12,14, 16 and 18 mesh together are pushing on each other with a fixed force determined by the magnitude of the load torque.

As shown in FIG. 1, an input shaft 34, sun gear 12, and output shaft 28 all lie on the same axis which is parallel to the planet gear shaft axis. Also, the arm 26 that carries the planet gears 14 and 16 is fixed to the input shaft 34 and therefore rotates with the input shaft 34 as it is rotated by the user. Therefore, rotation of the arm 26 forces the planet gears 14 and 16 to roll around the sun gear 12 and the output gear 18 as the input shaft 34 rotates. This, in turn, causes the gear teeth, which are being pressed together by the locked in load torque, to move into and out of mesh. In doing so, input power being generated by the user is dissipated as frictional power loss between the gear tooth surfaces as they slide and roll on each other during the meshing process.

The planetary gear train of FIG. 1 is designed to have a speed ratio of zero by properly specifying the tooth numbers for each of the four gears 12, 14, 16 and 18. The speed ratio for the planetary gear train of FIG. 1 is given as, $$\text{Speed Ratio} = \frac{\text{Output Speed}}{\text{Input Speed}} = \left(1 - \frac{N_{Sun}N_{Planet2}}{N_{Planet1}N_{Output}}\right) \quad (1)$$

As shown by this equation, the speed ratio will be zero when the product of the number of teeth on the sun gear ($N_{Sun}$) and the number of teeth on the second planet gear ($N_{Planet_2}$) is equal to the number of teeth on the first planet gear ($N_{Planet\ 1}$) and the output gear ($N_{Output}$). That is, when, $$N_{Sun}N_{Planet2}=N_{Planet1}N_{Output} \quad (2)$$

It is possible to construct alternative devices that operate on the same frictional power loss principle by using chain or belt drives instead of gears. In the chain version of the invention, a roller chain (or other type of chain) and sprockets would be used in place of the gears shown in FIG. 1. Similarly, in a belt version, the gears would be replaced by timing belts (or other belt type such as a V-belt or flat belt) and pulleys. These alternative designs will work in a similar manner to the planetary gear train device described as long as the number of teeth (or pitch diameter) are selected to give a speed ratio of zero. Because the length of chains and belts can vary due to manufacturing tolerances and use, a center distance adjustment may also be required in these alternative designs.

The preferred embodiment of the apparatus of the invention will depend on the requirements of the apparatus or device. If large amounts of power are to be dissipated, the gear device may be preferable. If small size and low weight are the goals, Then, a chain or belt drive may be the embodiment of choice. Also, the particular embodiment chosen will depend on anticipated production quantities and other manufacturing considerations.

Figure 2:
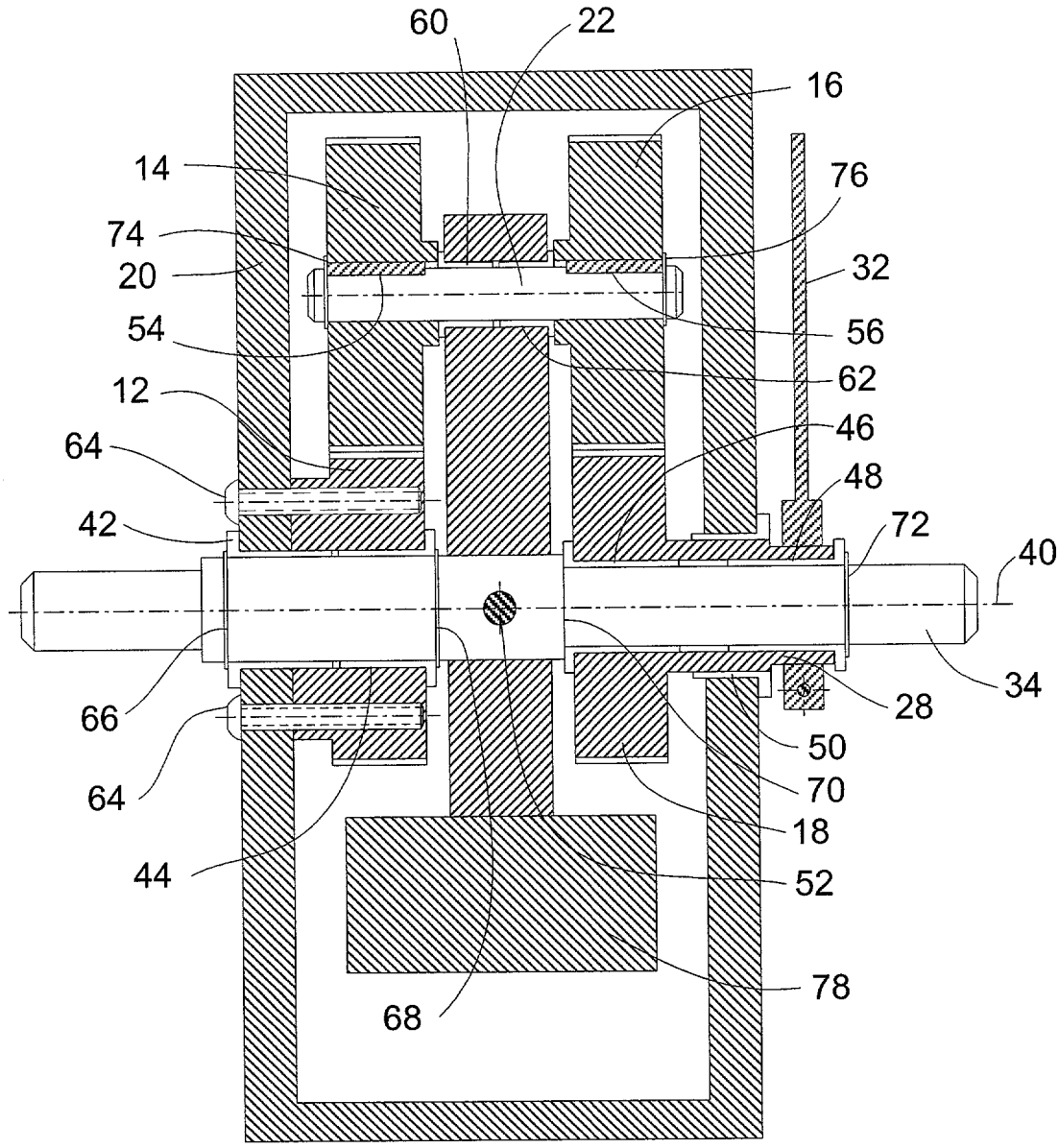
FIG. 2 is vertical cross-section through a framework mounting the apparatus of the present invention schematically illustrated in FIG. 2.
Figure 3:
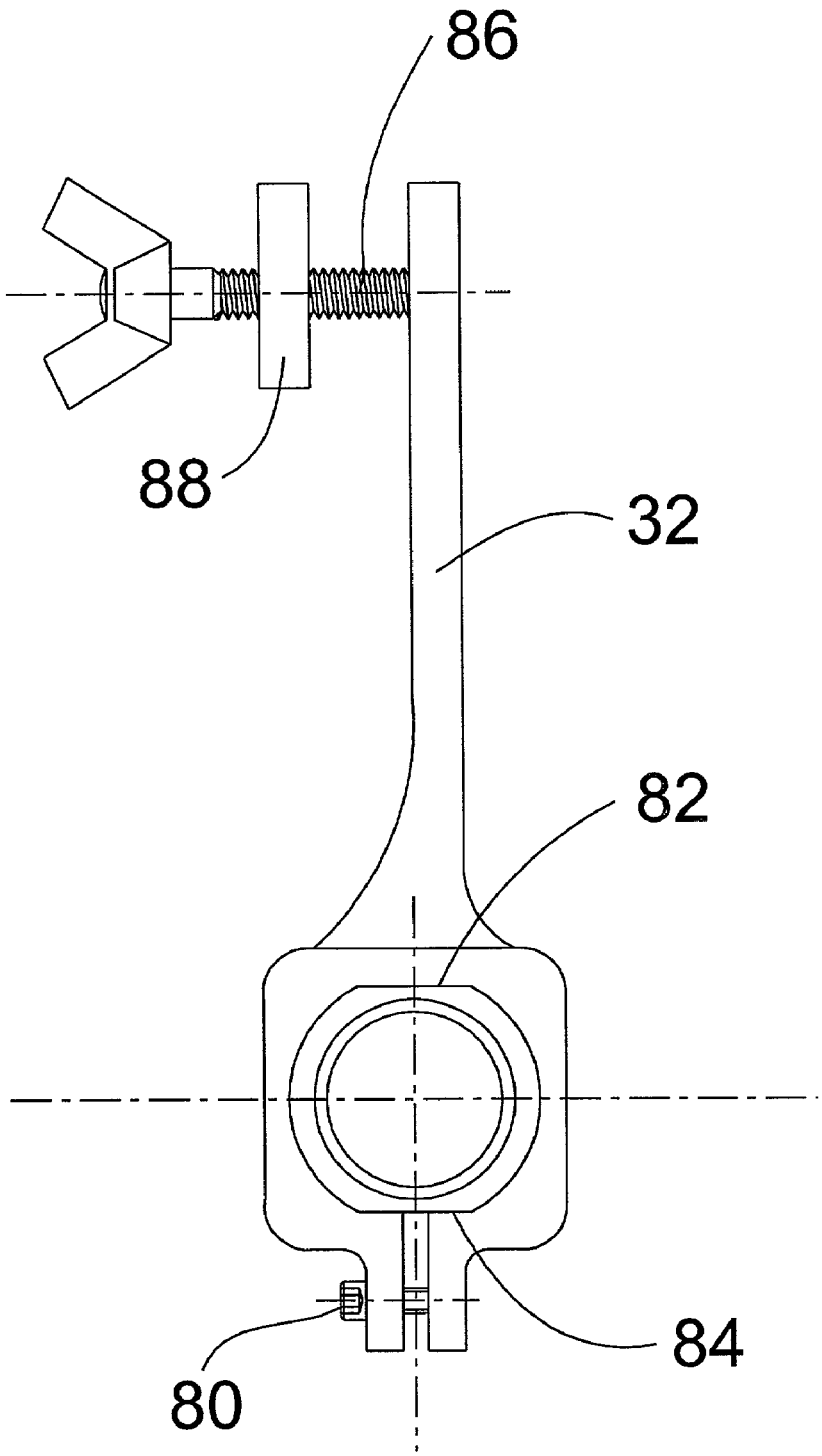
FIG. 3 is an end view taken along line 3—3 of FIG. 2 of a torque arm mounted on an outer end of a load torque shaft.

The planetary gear based design shown in FIGS. 1–3 is one possible preferred embodiment of the apparatus of the invention.

As shown in FIG. 2, the framework or housing 20 also mounts and supports the internal components of the device.

Referring to FIG. 2 the input shaft 34 is journaled for rotation about an axis 40 by sleeve bearings 42, 44, 46, 48 and 50. The shaft 34 passes all the way through the housing 20 so that foot or hand operated pedals can be used by the user to input power to input shaft 34.

Alternatively, a pulley, sprocket, gear, or other drive element could be attached to either end of input shaft 34 as a means for inputting power.

The arm 26 is attached to input shaft 34 by suitable means such as pin 52 so that it rotates with input shaft 34. Planet gears 14 and 16 are attached to planet shaft 10 by suitable means such as keys 54 and 56.

The planet shaft 22 is journaled for rotation about axis 58 by sleeve bearings 60 and 62. As shown, the planet gear 14 meshes with sun gear 12. The sun gear 12 is rigidly and permanently attached to the housing 20 using suitable means such as screws 64. The sun gear 12 is mounted so that it is concentric with axis 40.

The planet gear 16 meshes with output gear 18. The output gear 18 is integral with the output shaft 28 as shown in FIG. 3. Alternatively, the output gear 18 can be suitably attached to the output shaft 28. The output shaft 28 is journaled for rotation about axis 40 by sleeve bearings 46, 48 and 50.

Axial position of input shaft 34 with respect to housing 20 is provided by suitable means such as snap rings 66 and 68. Axial position of the output gear 18 and output shaft 28 with respect to input shaft 34 is provided by suitable means such as shoulder 70 and snap ring 72.

Axial position of the planetary gear 14 and 16 and the planet shaft 22 is provided by suitable means such as snap rings 74 and 76.

The weight of the planetary gears 14 and 16 and shaft 22 assembly is balanced by a counter weight 78.

Referring to FIG. 3, it will be seen that the load arm 32 is attached to the output shaft 28 by a suitable means such as clamping screw 80 and further prevented from rotating relative to output shaft 28 by flats 82 and 84. Load torque is applied to output shaft 28 by load screw 86 which is threadedly received in a threaded body 88 fixed to the housing 20 and which has an outer end that bears against an outer end of the load arm 32. The magnitude of the load torque is adjusted by turning the load screw 86.

In a very rigid system, most of the load torque will be stored as elastic deformation of load arm 32. Therefore, the load arm 32 is shaped to act as a cantilever leaf spring.

Figure 4:
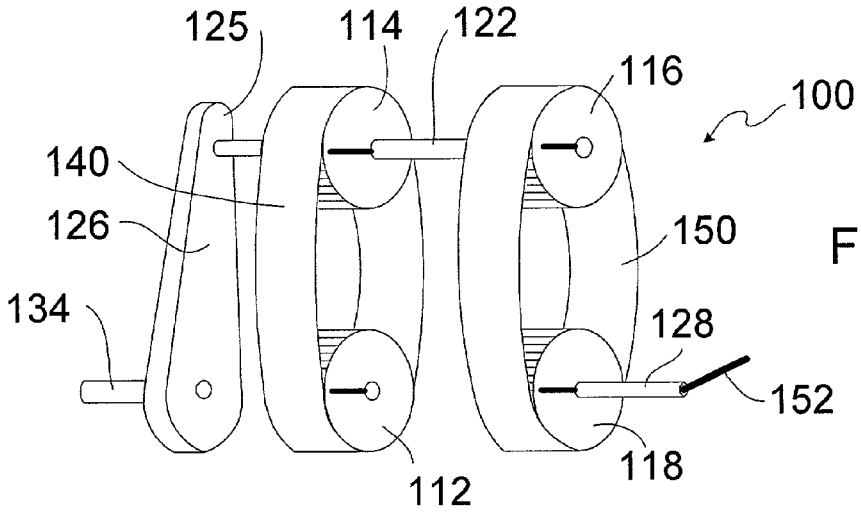
FIG. 4 is a schematic view of another embodiment of the apparatus of the present invention in an unloaded state.
Figure 5:
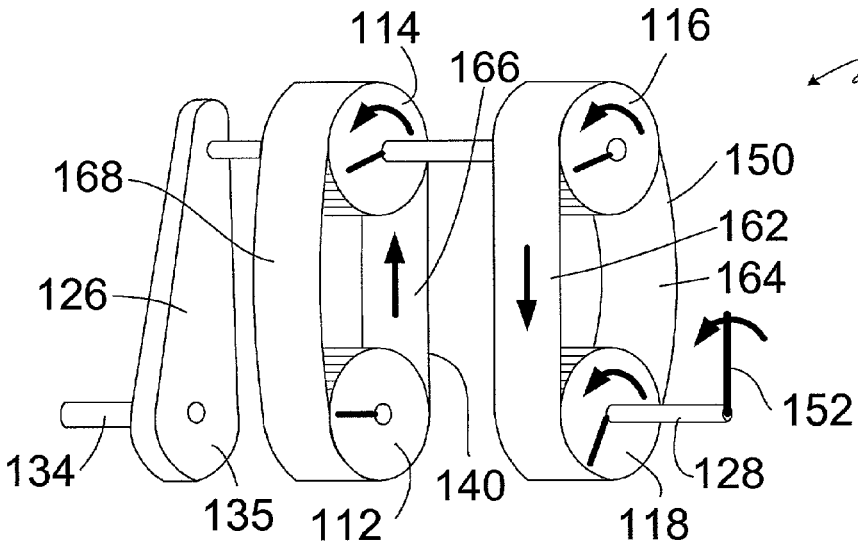
FIG. 5 is a schematic view similar to the view in FIG. 4, but showing the apparatus in a loaded state.

Referring now to FIGS. 4 and 5 there is illustrated therein another embodiment of an apparatus 100 constructed to the teachings of the present invention. As shown in FIG. 4, the apparatus 100 includes a fixed sun gear 112, a first planetary gear 114, a second planetary gear 116 and an output gear 118. The planetary gears 114 and 116 are fixed to a planetary shaft 122 which is mounted on one end 125 of arm 126. As shown, an output shaft 128 is fixed to the output gear 118.

Then, an input shaft 134 is mounted to another end 135 of the arm 126. The planetary gears 114 and 116 are spaced outwardly from the sun gear 112 and the output gear 118. The output shaft 128 and input shaft 130 are journalled in in a suitable housing (not shown) similar if not identical to the housing 20 shown in FIG. 2.

In this embodiment the gears 112, 114, 116, and 118 have teeth thereon or can be considered toothed pulleys 112, 114, 116, and 118. Then, a first belt 140 having alternating grooves and teeth on an inner surface thereof is fixed over the sun gear 112 and the planetary gear 114.

In the same manner, another belt 150 having alternating teeth and grooves on an inner surface thereof is trained over the planetary toothed pulley or gear 116 and the toothed output pulley or gear 118.

A torque arm 152 is schematically shown attached to the output shaft 128. It will be understood that the input shaft 134 and the output shaft 128 are journalled for rotation coaxially about the same axis.

Referring now to FIG. 5, when the torque arm 152 is rotated to rotate the output shaft 128 and the input gear 118 relative to the sun gear 112, tension is placed on the engaging parts of the system. In this respect, one portion 162 of the belt 150 on one side of the output gear 128 and planetary gear 116 is placed under tension while the portion 164 of the belt on the other side of the gears 116 and 118 is untensioned or urged to a relaxed state.

Then, one portion 166 of the belt 140 between the gears 112 and 114 is placed in tension while another portion 168 on the other side of the gears 112 and 114 is untensioned or urged to a relaxed state as shown in FIG. 5. The tensioned portions 162 and 166 of the belts 150 and 140 increase the friction between the parts of the assembly, for example, on the belts 140 and 150, the output shaft 128 and input shaft 134 and the bearings mounting the shafts 128 and 134 and the bearing mounting the planetary shaft 122 to the arm 126.

Stated in another way, the load torque placed on the load arm 152 is distributed throughout the mechanical system so that any frictional wear is distributed to all the rotatable shafts 128 and 134 and associated bearings (not shown) and, the bearing between shaft 122 and arm 126 and the friction between the teeth of the belts 150 and 140 and associated toothed pulleys or gears 112, 114, 116, and 118. As a result of this distribution of the load torque and resulting friction on all the moving parts and stationary parts adjacent the moving parts (as oppose to focusing the wear at one friction point) the useful life of the apparatus 110 before repairs or replacement of parts are required, is greatly enhanced.

From the forgoing description, it will be understood that the apparatus 10 or 110 of the present invention have a number of advantages some of which have been described above and others of which are inherent in the invention.

Also, it should be understood that modifications can be made to the apparatus 10 or 110 of the present invention without departing from the teachings of the present invention. For example, instead of toothed gears, sprockets can be used connected by chains instead of belts. Also, instead of toothed pulleys and belts, V-shaped belts and pulleys with a V-trough can be used.

Accordingly, the scope of the invention is only to be limited as necessitated by the accompanying claims.

I claim:

1. Apparatus for resisting motion comprising:

a framework having spaced apart, first and second sides;

a sun pulley fixedly mounted to said first side;

a rotably adjustable pulley mounted on said second side opposite said sun pulley;

a load torque shaft fixed to said adjustable pulley;

an input torque shaft positioned coaxial with said fixed sun pulley and with said load torque shaft and being rotable relative to said fixed sun pulley;

a user crank arm fixed to an outer end of said input torque shaft;

an arm having a first end fixed to said input torque shaft and a second end mounting a planetary shaft which extends transversely of said arm and parallel to an axis of said input torque shaft;

a first planetary pulley fixedly mounted on said planetary shaft in alignment with said fixed sun pulley;

a second planetary pulley fixedly mounted on said planetary shaft in alignment with said adjustable pulley;

a first belt or chain trained over said sun pulley and said first planetary pulley; and a second belt or chain trained over said adjustable pulley and said second planetary pulley, whereby placement of a torque on said load torque shaft fixed to said adjustable pulley will place tension on one length of said first belt or chain and tension on the other length of said second belt or chain thereby to establish friction between adjacent moving parts throughout the apparatus thereby to establish resistance to rotary movement of the input torque shaft with the amount of resistance being dependent on the amount of torque placed on said load torque shaft.

2. The apparatus of claim 1 wherein said belts are V-belts and said pulleys each have a V-trough for receiving one of the V-belts.

3. The apparatus of claim 1 wherein said arm is positioned between said fixed sun pulley and said adjustable pulley and said input torque shaft extends axially through and is rotatably journalled in said fixed sun pulley.

4. The apparatus of claim 1 wherein all of said pulleys have spaced apart teeth and grooves on an outer cylindrical periphery thereof and said belts each have spaced apart grooves and teeth on an inner surface thereof which mate with the teeth and grooves on two aligned pulleys to prevent slippage between pulleys and belts.

5. The apparatus of claim 1 wherein said belts are flat-belts and said pulleys each have a flat surface for receiving one of said flat-belts.

6. The apparatus of claim 1 wherein each of said belts is round with a circular cross-section and each of said pulleys is one of flat or has a semi-circular trough for receiving one of said round belts.

7. The apparatus of claim 1 including a lever arm mounted to said load torque for applying a torque to said load torque shaft and adjustable holding means for holding said lever arm in one of a plurality of selected positions relative to said load torque shaft.

8. The apparatus of claim 6 wherein said adjustable holding means include a member having a threaded hole, said member being fixed to said framework and a rod coupled to said lever arm and having a threaded portion is threadably received in said threaded hole.

9. Apparatus for resisting motion comprising:

a framework having spaced apart first and second sides;

a sun sprocket fixedly mounted to said first side;

a rotatably adjustable sprocket mounted on said second side opposite said sun sprocket;

a load torque shaft fixed to said adjustable sprocket;

an input torque shaft positioned coaxial with said fixed sun sprocket and with said load torque shaft and being rotatable relative to said fixed sun sprocket;

a user crank arm fixed to an outer end of said input torque shaft;

an arm having a first end fixed to said input torque shaft and a second end mounting a planetary shaft which extends transversely of said arm and parallel to an axis of said input torque shaft;

a first planetary sprocket fixedly mounted on said planetary shaft in alignment with said fixed sun sprocket;

a second planetary sprocket fixedly mounted on said planetary shaft in alignment with said adjustable sprocket;

a first chain trained over said sun sprocket and said first planetary sprocket; and a second chain trained over said adjustable sprocket and said second planetary sprocket, whereby placement of a torque on said load torque shaft fixed to said adjustable sprocket will place tension on one length of said first chain and tension on the other length of said second chain thereby to establish friction between adjacent moving parts throughout the apparatus thereby to establish resistance to rotary movement of the input torque shaft with the amount of resistance being dependent on the amount of torque placed on said load torque shaft.

10. Apparatus for resisting motion comprising:

a framework having spaced apart, first and second sides;

a sun gear fixedly mounted to said first side;

a rotatably adjustable gear mounted on said second side opposite said sun gear;

a load torque shaft fixed to said adjustable gear;

an input torque shaft positioned coaxial with said fixed sun gear and with said load torque shaft and being rotatable relative to said fixed sun gear;

a user crank arm fixed to an outer end of said input torque shaft;

an arm having a first end fixed to said input torque shaft and a second end mounting a planetary shaft which extends traversely of said arm and parallel to an axis of said input torque shaft;

a first planetary gear fixedly mounted on said planetary shaft in alignment and engagement with said fixed sun gear;

a second planetary gear fixedly mounted on said planetary shaft in alignment and engagement with said adjustable gear, whereby placement of a torque on said load torque shaft fixed to said adjustable gear will place load on engaging teeth between said adjustable gear and said second planetary gear and on the engaging teeth between said first planetary gear and said fixed sun gear thereby to establish friction between adjacent moving parts throughout the apparatus thereby to establish resistance to rotary movement of the input torque shaft with the amount of resistance to rotary movement of the input torque shaft with the amount of resistance being dependent on the amount of torque placed on said load torque shaft.

11. The apparatus of claim 10 wherein at least one of said fixedly mounted sun gear and said adjustable gear is an internal gear.

12. A motion resistance apparatus for an exercise device comprising:

a rotatable input shaft;

a user drive device coupled to said input shaft for receiving input torque from an external source and applying said input torque to said input shaft;

an output shaft;

an adjustment mechanism for selectively applying a load torque to said output shaft; and a gear system coupled between said input shaft and said output shaft, said gear system configured such that the torque required to rotate said input sat is a function of the selected load torque applied to said output shaft, said gear system further configured such that the ratio of said output speed to said input speed is zero.

13. The motion resistance apparatus as recited in claim 12 wherein said drive device is directly coupled to said input shaft.

14. The motion resistance apparatus as recited in claim 13 wherein said drive device includes at least one pedal.

15. The motion resistance apparatus as recited in claim 13 wherein said drive device includes at least one crank.

16. The motion resistance apparatus as recited in claim 12 wherein said drive device is indirectly coupled to said input shaft.

17. The motion resistance apparatus as recited in claim 16 wherein said drive device includes a belt.

18. The motion resistance apparatus as recited in claim 16 wherein said drive device includes a chain.

19. The motion resistance apparatus as recited in claim 12 wherein said adjustment mechanism includes a lever arm and a mechanism for applying torque to said output shaft.

20. The motion resistance apparatus as recited in claim 12 wherein said gear train includes at lest one planetary gear.

* * * * *